US007048355B2

(12) United States Patent
Torgerson et al.

(10) Patent No.: US 7,048,355 B2
(45) Date of Patent: May 23, 2006

(54) HIGH-PERFORMANCE, HIGH-DENSITY INK JET PRINTHEAD HAVING MULTIPLE MODES OF OPERATION

(75) Inventors: Joseph M. Torgerson, Philomath, OR (US); Angela W. Bakkom, Corvallis, OR (US); Mark H. MacKenzie, Corvallis, OR (US); Simon Dodd, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 106 days.

(21) Appl. No.: 10/434,880

(22) Filed: May 9, 2003

(65) Prior Publication Data

US 2003/0202045 A1 Oct. 30, 2003

Related U.S. Application Data

(63) Continuation of application No. 09/640,286, filed on Aug. 16, 2000, now abandoned.

(51) Int. Cl.
*B41J 2/145* (2006.01)
*B41B 15/00* (2006.01)

(52) U.S. Cl. ..... 347/40; 358/1.2

(58) Field of Classification Search ..... 347/43, 347/15, 40, 12, 85, 41, 84, 86; 358/1.2, 1.9
See application file for complete search history.

(56) References Cited

U.S. PATENT DOCUMENTS

| | | | | | |
|---|---|---|---|---|---|
| 5,030,971 | A | * | 7/1991 | Drake et al. | 347/57 |
| 5,877,793 | A | * | 3/1999 | Erickson | 347/85 |
| 6,048,052 | A | | 4/2000 | Kitahara et al. | |
| 6,170,932 | B1 | * | 1/2001 | Kanaya et al. | 347/41 |
| 6,325,489 | B1 | * | 12/2001 | Endo | 347/43 |
| 6,585,352 | B1 | * | 7/2003 | Torgerson et al. | 347/40 |
| 6,742,866 | B1 | * | 6/2004 | Anderson et al. | 347/40 |

* cited by examiner

*Primary Examiner*—Lamson Nguyen

(57) ABSTRACT

The present invention includes as one embodiment an inkjet printhead including a plurality of ink drop generators configured to recieve a same color of ink and grouped into four axis groups, each of the four axis groups including a plurality of nozzles arranged along one of four axes, wherein the drop generators are staggered with respect to one another to decrease an effective pitch of the inkjet printhead to substantially one fourth of the pitch of a single one of the four axis groups.

27 Claims, 9 Drawing Sheets

HIGH-PERFORMANCE, HIGH-DENSITY INK JET PRINTHEAD HAVING MULTIPLE MODES OF OPERATION

This application is a continuation of Ser. No. 09/640,286 filed Aug. 16, 2000, abandoned.

BACKGROUND OF THE INVENTION

1. Field of the Invention

The present invention relates in general to thermal ink jet (TIJ) printheads and more specifically to a system and method for high-performance printing having multiple modes of operation that uses a monochrome ink jet printhead having a staggered, high-density arrangement of ink drop generators.

2. Related Art

Thermal ink jet (TIJ) printers are popular and widely used in the computer field. These printers are described by W. J. Lloyd and H. T. Taub in "Ink Jet Devices," Chapter 13 of *Output Hardcopy Devices* (Ed. R. C. Durbeck and S. Sherr, San Diego: Academic Press, 1988) and U.S. Pat. Nos. 4,490,728 and 4,313,684. Ink jet printers produce high-quality print, are compact and portable, and print quickly and quietly because only ink strikes a print medium (such as paper).

An ink jet printer produces a printed image by printing a pattern of individual dots (or pixels) at specific defined locations of an array. These dot locations, which are conveniently visualized as being small dots in a rectilinear array, are defined by the pattern being printed. The printing operation, therefore, can be pictured as the filling of a pattern of dot locations with dots of ink.

Ink jet printers print dots by ejecting a small volume of ink onto the print medium. An ink supply device, such as an ink reservoir, supplies ink to the ink drop generators. The ink drop generators are controlled by a microprocessor or other controller and eject ink drops at appropriate times upon command by the microprocessor. The timing of ink drop ejections generally corresponds to the pixel pattern of the image being printed.

In general, the ink drop generators eject ink drops through an orifice (such as a nozzle) by rapidly heating a small volume of ink located within a vaporization or firing chamber. The vaporization of the ink drops typically is accomplished using an electric heater, such as a small thin-film (or firing) resistor. Ejection of an ink drop is achieved by passing an electric current through a selected firing resistor to superheat a thin layer of ink located within a selected firing chamber. This superheating causes an explosive vaporization of the thin layer of ink and an ink drop ejection through an associated nozzle of the printhead.

Ink drop ejections are positioned on the print medium by a moving carriage assembly that supports a printhead assembly containing the ink drop generators. The carriage assembly traverses over the print medium surface and positions the printhead assembly depending on the pattern being printed. The carriage assembly imparts relative motion between the printhead assembly and the print medium along a "scan axis". In general, the scan axis is in a direction parallel to the width of the print medium and a single "scan" of the carriage assembly means that the carriage assembly displaces the printhead assembly once across approximately the width of the print medium. Between scans, the print medium is typically advanced relative to the printhead along a "media advance axis" that is perpendicular to the scan axis (and generally along the length of the print medium).

As the printhead assembly is moved along the scan axis a swath of intermittent lines are generated. The superposition of these intermittent lines creates the appearance as text or image of a printed image. Print resolution along the media advance axis is often referred to as a density of these intermittent lines along the media advance axis. Thus, the higher the density of the intermittent lines in the media advance axis the greater the print resolution along that axis.

The density of the intermittent lines along the media advance axis (and thus the paper axis print resolution) can be increased by adjusting the "step" between sequential scans. For example, if it takes an average of two steps to cover a swath equal to the length of a nozzle array aligned with the media advance axis, this is referred to as "two-pass printing". The swaths in this case would be offset by a distance equal to a non-integer number of nozzle pitch lengths (measured along paper axis) to allow the pitch of intermittent lines to be halved. This effectively doubles the resolution along the paper axis. One major disadvantage, however, of two-pass printing is that the extra passes greatly decrease the speed of the printer. For instance, two-pass printing is about half the print speed of one-pass printing. Such a large decrease in print speed is undesirable for some printing operations, but acceptable in others.

Another technique that may be used to increase the density of the intermittent lines along the media advance axis is to increase the density of the nozzle spacing to provide a high print resolution in one-pass printing. However, it is quite difficult to manufacture ink drop generator and nozzle structures that allow the high linear density of nozzles required for high print resolution printing. For instance, ink drop generators must be fine enough to allow for tight spacing, ink drop volume must decrease with the tighter spacing, and the subsequent lower drop volume may not be compatible with the desired print mode. There exists a need, therefore, for an ink jet printhead capable of multi-mode operation that allows for high-resolution, high-speed printing in one print application while also providing a high resolution maximum quality print mode in another print application.

SUMMARY OF THE INVENTION

The present invention includes as one embodiment an inkjet printhead including a plurality of ink drop generators configured to receive a same color of ink and grouped into four axis groups, each of the four axis groups including a plurality of nozzles arranged along one of four axes, wherein the drop generators are staggered with respect to one another to decrease an effective pitch of the inkjet printhead to substantially one fourth of the pitch of a single one of the four axis groups.

BRIEF DESCRIPTION OF THE DRAWINGS

The present invention can be further understood by reference to the following description and attached drawings that illustrate the preferred embodiment. Other features and advantages will be apparent from the following detailed description of the preferred embodiment, taken in conjunction with the accompanying drawings, which illustrate, by way of example, the principles of the present invention.

Referring now to the drawings in which like reference numbers represent corresponding parts throughout.

DETAILED DESCRIPTION OF THE PREFERRED EMBODIMENTS

Figure 1:
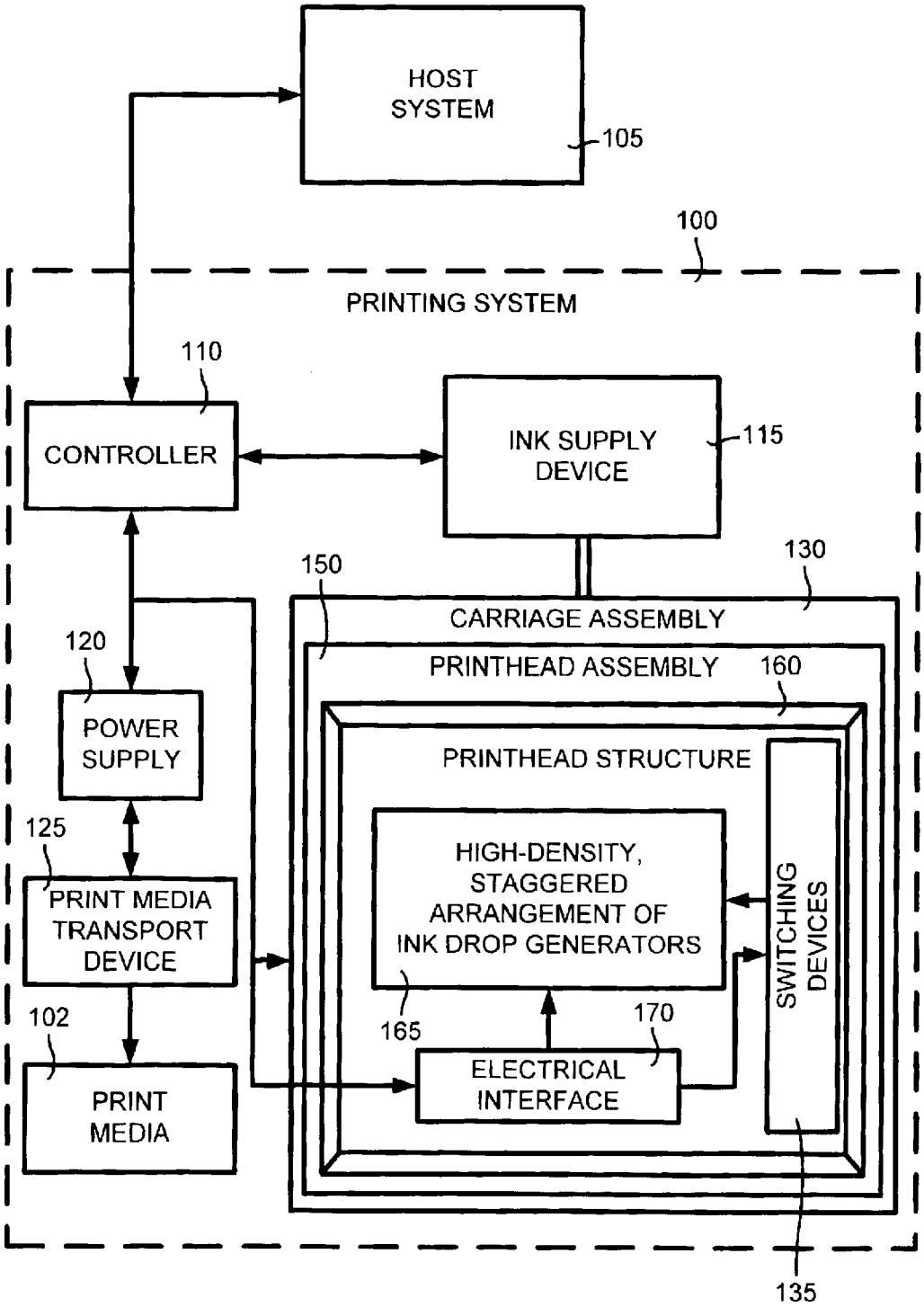
FIG. 1 is a block diagram of an overall printing system incorporating the present invention.

In the following description of the invention, reference is made to the accompanying drawings, which form a part thereof, and in which is shown by way of illustration a specific example whereby the invention may be practiced. It is to be understood that other embodiments may be utilized and structural changes may be made without departing from the scope of the present invention.

I. General Overview

The present invention is embodied in a monochrome printhead having a high-density arrangement of interleaved or staggered ink drop generators. This arrangement provides the present invention with high-resolution and high-speed printing. The present invention has the ink drop generators arranged in at least three groups along at least three axes. An axis group contains a plurality of ink drop generators that are arranged along the corresponding axis (such as in a columnar group). Each axis has a centerline that is substantially parallel to a reference axis. An axis group is staggered with respect to the other. Each axis group has an axis pitch, and one result of staggering is that an effective (or combined) pitch of the printhead is a fraction of the axis pitch. Staggering the arrangement of ink drop generators allows for higher resolution printing in fewer passes and provides high print speed at high resolution by increasing the effective nozzle density in the media advance axis.

By utilizing a printhead design that allows for various printing modes, the present invention allows quality, speed, or a combination thereof to be optimized according to a particular printing application. The structural and electrical modifications are discussed in co-pending patent application Hewlett-Packard Docket No. 10003553-1, Ser. No. 09/626,367 entitled "COMPACT HIGH-PERFORMANCE, HIGH-DENSITY INK JET PRINTHEAD" by Joe Torgerson et al. and filed on the same date of the present application. When the present invention is operated in a print mode that maximizes quality, the printhead is sensitive to even slight variations in ink drop placement accuracy from the printhead onto a print media. An artifact of the printhead manufacturing process is a geometric variation within the printhead that can cause ink drop trajectory variation across the printhead. This error is generally acceptable for high-quality printing. However, for the highest quality printing the effect of this variation may not be acceptable.

The present invention addresses this issue by providing multiple modes of operation whereby different modes are available depending on the desired print speed, resolution and quality. For example, as discussed further below, the present invention is capable of printing in a high-quality, one-pass bidirectional 1200 dpi mode having a medium speed and a relatively slower but higher quality two-pass 1200 dpi. These various modes allow the printhead of the present invention to trade off speed and quality depending on the print application. For example, the bidirectional single-pass 1200 dpi mode uses all of the axis groups at once and tends to have some quality reduction due to particular ink drop trajectory errors that are dependent on the nozzle layout. The slower speed two-pass 1200 dpi mode uses a portion of the axis groups and allows for the elimination of such nozzle layout dependent trajectory errors.

In a preferred embodiment, the present invention includes a printhead using black ink and having four pluralities of ink drop generators each arranged along one of four axes that are each parallel to a reference axis and transversely spaced apart from each other. As explained in detail below, each plurality of ink drop generators along an axis (or an axis group) has an axis pitch (300 dpi in an exemplary embodiment) relative to the reference axis, and all four axis groups provide a combined effective pitch of one-fourth the axis pitch with respect to the reference axis (1200 dpi in a preferred embodiment). Thus, by staggering the nozzles with respect to the reference axis, the present invention quadruples the effective pitch (and nozzle density) of the entire printhead. This permits one-pass printing to have the equivalent print resolution of what could previously be accomplished with four-pass printing (assuming a single axis group of nozzles). In another preferred embodiment, the printhead uses selected pairs of axis groups so that the printhead has a combined effective pitch of one-half the axis pitch. This embodiment provides two-pass unidirectional printing that eliminates the effect of the aforementioned artifact of printhead manufacturing. In addition, this embodiment provides the same print resolution provided by the embodiment above.

II. Structural Overview

FIG. 1 is a block diagram of an overall printing system incorporating the present invention. The printing system 100 can be used for printing a material, such as ink on a print media 102, which can be paper. The printing system 100 is coupled to a host system 105 (such as a computer or microprocessor) for producing print data. The printing system 100 includes a controller 110, a power supply 120, a print media transport device 125, a carriage assembly 130 and a plurality of switching devices 135. The ink supply device 115 is fluidically coupled to a printhead assembly 150 for selectively providing ink to the printhead assembly 150. The print media transport device 125 provides a means to move a print media 102 (such as paper) relative to the printing system 100. Similarly, the carriage assembly 130 supports the printhead assembly 150 and provides a means to move the printhead assembly 150 to a specific location over the print media 102 as instructed by the controller 110.

The printhead assembly 150 includes a printhead structure 160. As described in more detail below, the printhead structure 160 of the present invention contains a plurality of various layers including a substrate (not shown). The substrate may be a single monolithic substrate that is made of any suitable material (preferably having a low coefficient of thermal expansion), such as, for example, silicon. The printhead structure 160 also includes a high-density, staggered arrangement of ink drop generators 165 formed in the printhead structure 160 that contains a plurality of elements for causing an ink drop to be ejected from the printhead assembly 150. The printhead structure 160 also includes an electrical interface 170 that provides energy to the switching devices 135 that in turn provide power to the high-density, staggered arrangement of ink drop generators 165.

During operation of the printing system 100, the power supply 120 provides a controlled voltage to the controller 110, the print media transport device 125, the carriage assembly 130 and the printhead assembly 150. In addition, the controller 110 receives the print data from the host system 105 and processes the data into printer control information and image data. The processed data, image data and other static and dynamically generated data are provided to the print media transport device 125, the carriage assembly 130 and the printhead assembly 150 for efficiently controlling the printing system 100.

Exemplary Printing System

Figure 2:
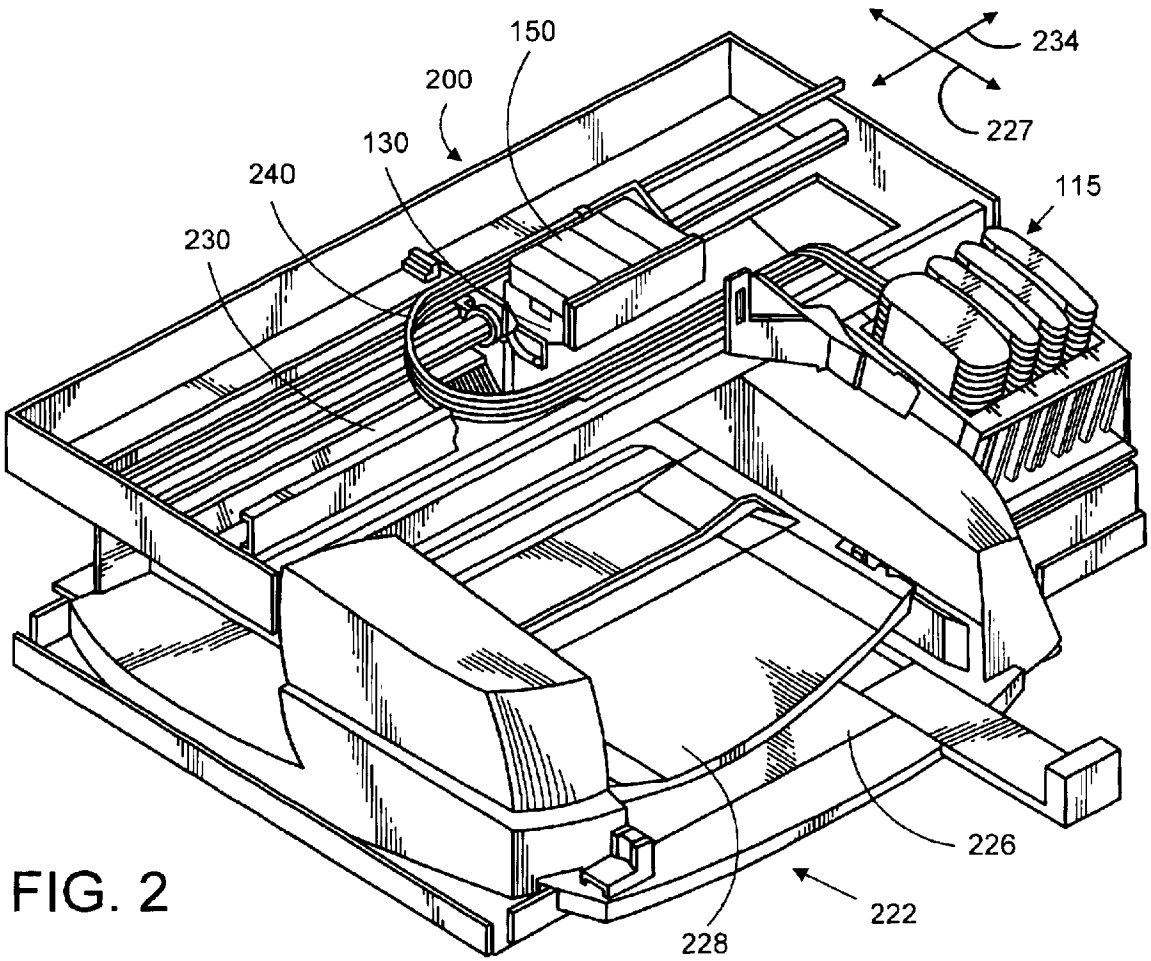
FIG. 2 is an exemplary printing system that incorporates the present invention and is shown for illustrative purposes only.

FIG. 2 is an exemplary printing system that incorporates the high-performance, high-density ink jet printhead of the present invention and is shown for illustrative purposes only. As shown in FIG. 2, the printing system 200 includes a tray 222 for holding print media. When a printing operation is initiated, the print media is transported into the printing system 200 from the tray 222 preferably using a sheet feeder 226 in a media advance 227 direction. The print media is then transported in a U-direction within the printing system 200 and exits in the opposite direction of entry toward an output tray 228. Other print media paths, such as a straight paper path, may also be used.

Upon entrance into the printing system 200 the print media is paused within a print zone 230 and the carriage assembly 130, which supports at least one printhead assembly 150 of the present invention, is then moved (or scanned) across the print media in a scan axis 234 direction for printing a swath of ink drops thereon. The printhead assembly 150 can be removeably mounted or permanently mounted to the carriage assembly 130. In addition, the printhead assembly 150 is coupled to an ink supply device 115. The ink supply device may be a self-contained ink supply device (such as a self-contained ink reservoir). Alternatively, the printhead assembly 150 may be fluidically coupled, via a flexible conduit, to an ink supply device 115. As a further alternative, the ink supply device 115 may be one or more ink containers separate or separable from the printhead assembly 150 and removeably mounted to the carriage assembly 130.

Figure 3:
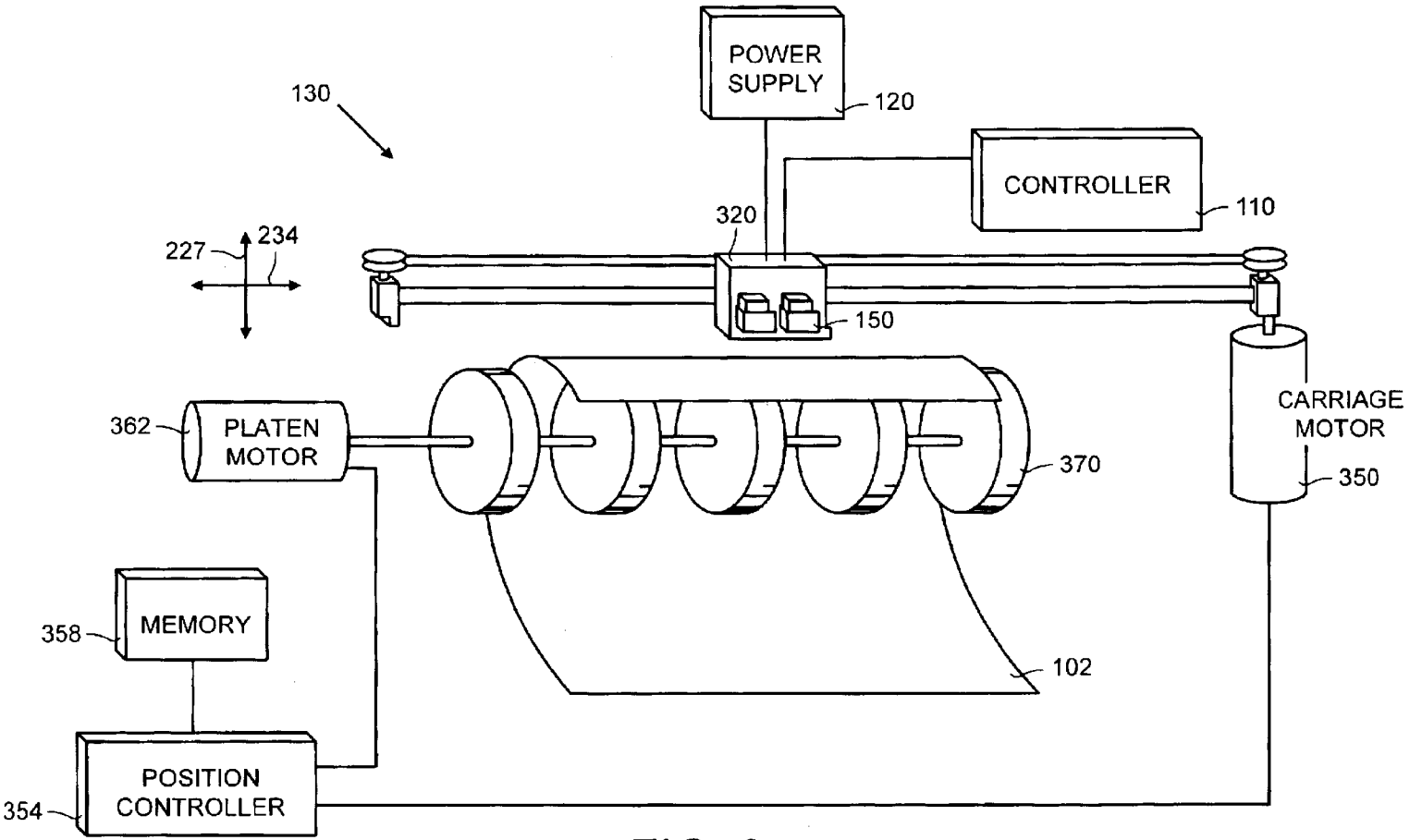
FIG. 3 is a schematic representation illustrating an exemplary carriage assembly of the printing system of FIG. 2 that supports the printhead assembly of the present invention.

FIG. 3 is a schematic representation illustrating an exemplary carriage assembly of the printing system of FIG. 2 that the high-performance, high-density ink jet printhead of the present invention. The carriage assembly 130 includes a scanning carriage 320 that supports the printhead assembly 150, which may be removable or permanently mounted to the scanning carriage 320. The controller 110, is coupled to the scanning carriage 320 and provides control information to the printhead assembly 150.

The scanning carriage 320 is moveable along a straight path direction in the scan axis 234. A carriage motor 350, such as stepper motor, transports the scanning carriage 320 along the scan axis 234 according to commands from a position controller 354 (which is in communication with the controller 110). The position controller 354 is provided with memory 358 to enable the position controller 354 to know its position along the scan axis 234. The position controller 354 is coupled to a platen motor 362 (such as a stepper motor) that transports the print media 102 incrementally. The print media 102 is moved by a pressure applied between the print media 102 and a platen 370. Electrical power to run the electrical components of the printing system 200 (such as the carriage motor 350 and the platen motor 362) as well as energy to cause the printhead assembly 150 to eject ink drops is provided by the power supply 120.

A print operation occurs by feeding the print media 102 from the tray 222 and transporting the print media 102 into the print zone 230 by rotating the platen motor 362 and thus the platen 370 in the media advance axis 227. When the print media 102 is positioned correctly in the print zone 330, the carriage motor 350 positions (or scans) the scanning carriage 320 and printhead assembly 150 over the print media 102 in the scan axis 234 for printing. After a single scan or multiple scans, the print media 102 is then incrementally shifted by the platen motor 362 in the media advance axis 227 thereby positioning another area of the print media 102 in the print zone 230. The scanning carriage 320 again scans across the print media 102 to print another swath of ink drops. The process is repeated until the desired print data has been printed on the print media 102 at which point the print media 102 is ejected into the output tray 228.

III. Printhead Architecture

The printhead of the present invention includes a high-density interleaved arrangement of ink drop generators that provides high-resolution printing at high speed. In a preferred embodiment, a plurality of ink drop generators are arranged along at least three axes. Each plurality of ink drop generators along an axis (an axis group) has an axis pitch measured along a reference axis. For example, in an exemplary embodiment the axis pitch is equal to $1/300^{th}$ of an inch. Assuming there are four axis groups on the printhead, the staggered arrangement provides an effective print resolution of 1200 dpi. Although manufacturing artifacts tend to affect print quality, the present invention mitigates this effect by providing for multiple modes of operation. As explained in detail below, the printhead of the present invention may be operated in a plurality of print modes depending on the requirements for print speed and quality.

Figure 4:
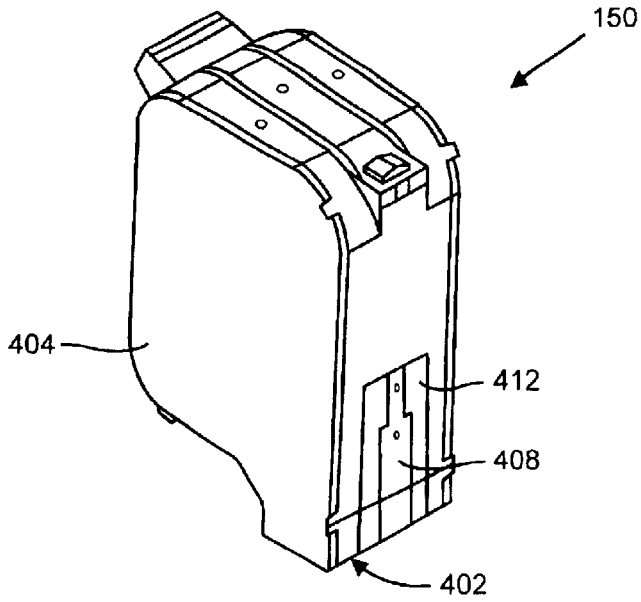
FIG. 4 is a perspective view of the printhead assembly of the present invention and is shown for illustrative purposes only.

FIG. 4 is a perspective view of the printhead assembly of the present invention and is shown for illustrative purposes only. A detailed description of the present invention follows with reference to a typical printhead assembly used with a typical printing system, such as printer 200 of FIG. 2. However, the present invention can be incorporated in any printhead and printer configuration. Referring to FIGS. 1 and 2 along with FIG. 4, the printhead assembly 150 is comprised of a thermal inkjet head assembly 402 and a printhead body 404. The thermal inkjet head assembly 402 can be a flexible material commonly referred to as a Tape Automated Bonding (TAB) assembly and can contain interconnect pads 412. The interconnect pads 412 are suitably secured to the printhead assembly 150 (also called a print cartridge), for example, by an adhesive material. The contact pads 408 align with and electrically contact electrodes (not shown) on the carriage assembly 130.

High-Density Array of Interleaved Ink Drop Generators

Figure 5:
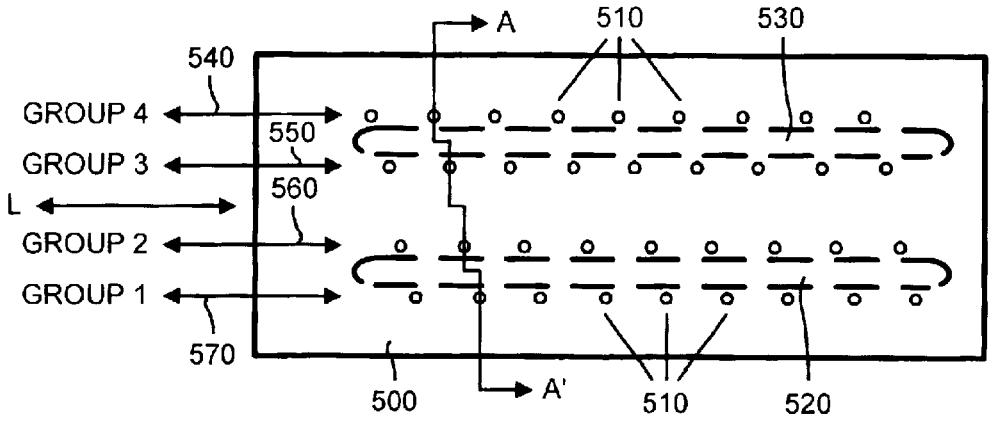
FIG. 5 is a simplified schematic plan view of the printhead assembly shown in FIG. 4 illustrating the staggered ink drop generator arrangement of the present invention.

FIG. 5 is a simplified schematic plan view of the printhead assembly shown in FIG. 4 illustrating the interleaved ink drop generator arrangement of the present invention. The printhead assembly includes a high-performance printhead 500 of the present invention having a plurality of nozzles 510 and a first ink feed slot 520 and a second ink feed slot 530. The ink feed slots 520, 530 provide ink to the ink drop generators from the ink supply device 115. Fluidically coupled to each nozzle 510 and preferably underlying the nozzle 510 is a corresponding high-density array of ink drop generators (not shown). This array ink drop generators includes a plurality of high-resistance firing resistors (not shown) that heat ink within a firing chamber supplied by the ink feed slots 520, 530 in order to eject an ink drop from each nozzle 510.

The plurality of nozzles 510 is arranged into groups of ink drop generators along at least three axes (axis groups). The axes are spaced apart transversely with each other and with respect to a reference axis L. As shown in FIG. 5, in a preferred embodiment the high-performance printhead 500 of the present invention includes four groups of nozzles 510 with each group arranged along a separate axis. In particular, a first group of nozzles is arranged along a first axis 540, a second group of nozzles is arranged along a second axis 550, a third group of nozzles is arranged along a third axis 560 and a fourth group of nozzles is arranged along a fourth axis 570. Each of these axes 540, 550, 560, 570 is parallel to each other and with the reference axis L. In use, the reference axis L is preferably aligned with the media advance axis 227 shown in FIGS. 2 and 3.

Figure 6:
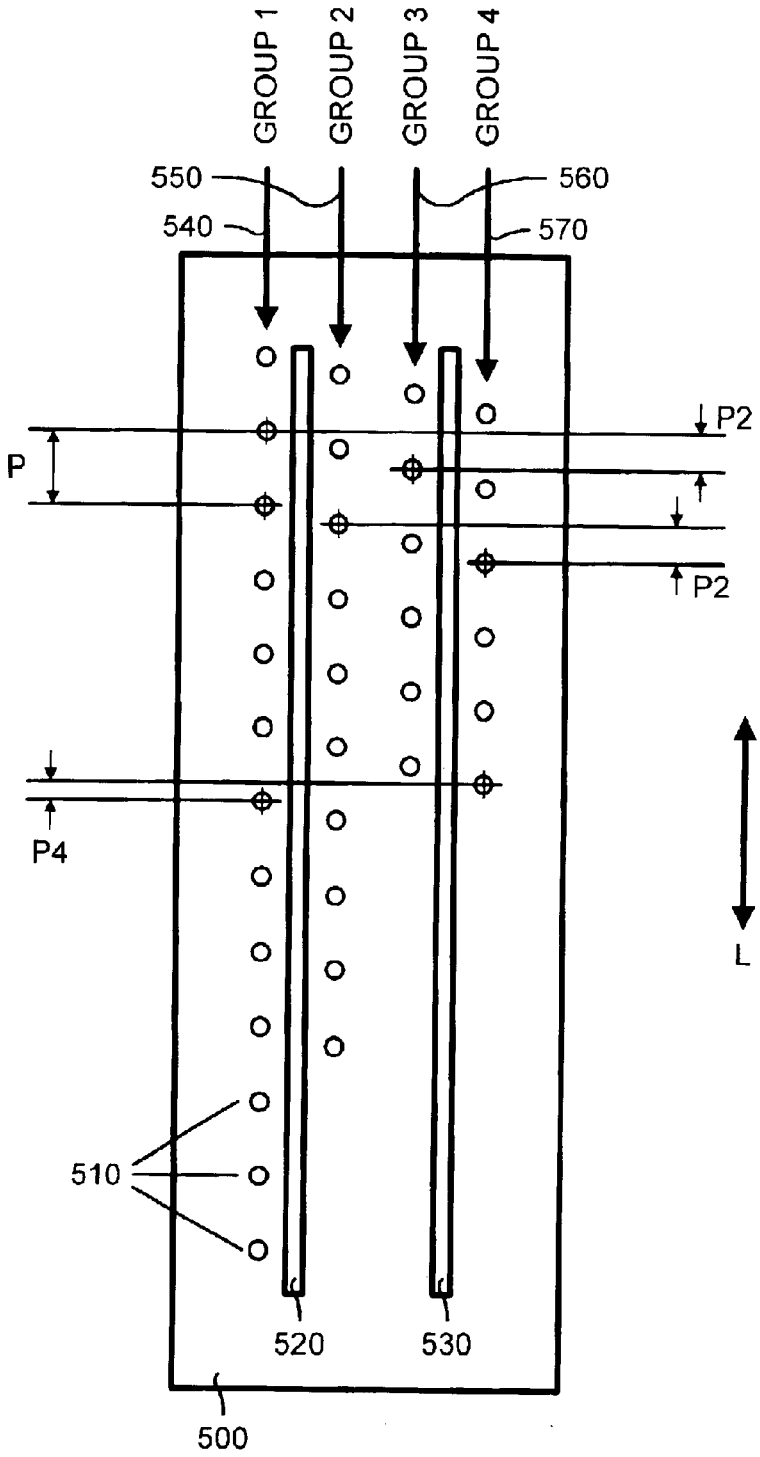
FIG. 6 is another simplified schematic intended to further illustrate in plan view the interleaved or staggered arrangement of nozzles of the present invention.

FIG. 6 is another simplified schematic intended to further illustrate in plan view the interleaved or staggered arrangement of nozzles of the present invention. In a preferred embodiment each axis group or columnar arrangement of nozzles has the same center-to-center spacing or axis pitch P with respect to the reference axis L. The four groups of nozzles, 540, 550, 560, and 560 are staggered with respect to each other such that the combined center-to-center spacing P4 (with respect to the reference axis L) of all four groups is equal to P/4, or one fourth of the axis pitch P. Stated another way, the groups are staggered with respect to each other to allow the printhead 500 to have four times the effective resolution of any one particular group of nozzles.

There are two sets of two groups of nozzles that are interleaved to effectively double the resolution of any single group. Group 540 and group 560 form a first pair of groups that are staggered with respect to each other such that the combined center-to-center spacing P2 with respect to the reference axis L of the first pair is equal to P/2, or one half of the axis pitch P. Likewise, group 550 and group 570 form a second pair of groups that are staggered with respect to each other such that the combined center-to-center spacing P2 with respect to the reference axis L of the second pair is equal to P/2, or one half of the axis pitch P.

In an exemplary embodiment, the axis pitch P of a single group with respect to reference axis L is equal to $1/300^{th}$ of an inch, providing each group with an effective resolution of 300 dpi. Thus, either the first pair (group 540 and group 560) or the second pair (group 550 and group 570) has a combined or effective pitch with respect to reference axis L equal to $1/600^{th}$ of an inch. The combination of all four staggered groups (540, 550, 560, and 570) has a combined or effective nozzle pitch with respect to reference axis L of $1/1200^{th}$ of an inch providing printhead 500 with an effective resolution of 1200 dpi.

FIG. 6 illustrates each axis group (540, 550, 560, or 570) arranged along the ink feed slots 520, 530. Each ink feed slot has two opposing longitudinal edges, with an axis group arranged adjacent to each longitudinal edge. As shown in FIG. 6, in a preferred embodiment the first axis group 540 (group 1) and the second axis group 550 (group 2) are arranged on opposing sides of the first ink feed slot 520 and the third axis group 560 (group 3) and the fourth axis group 570 (group 4) are arranged on opposing sides of the second ink feed slot 530. While the nozzles of each axis group are illustrated as being substantially collinear, it should be appreciated that some of the nozzles of a particular axis group may be slightly off center line, for example to compensate for drop ejector timing delays.

Multiple Mode Operation of the Printhead

Figure 7:
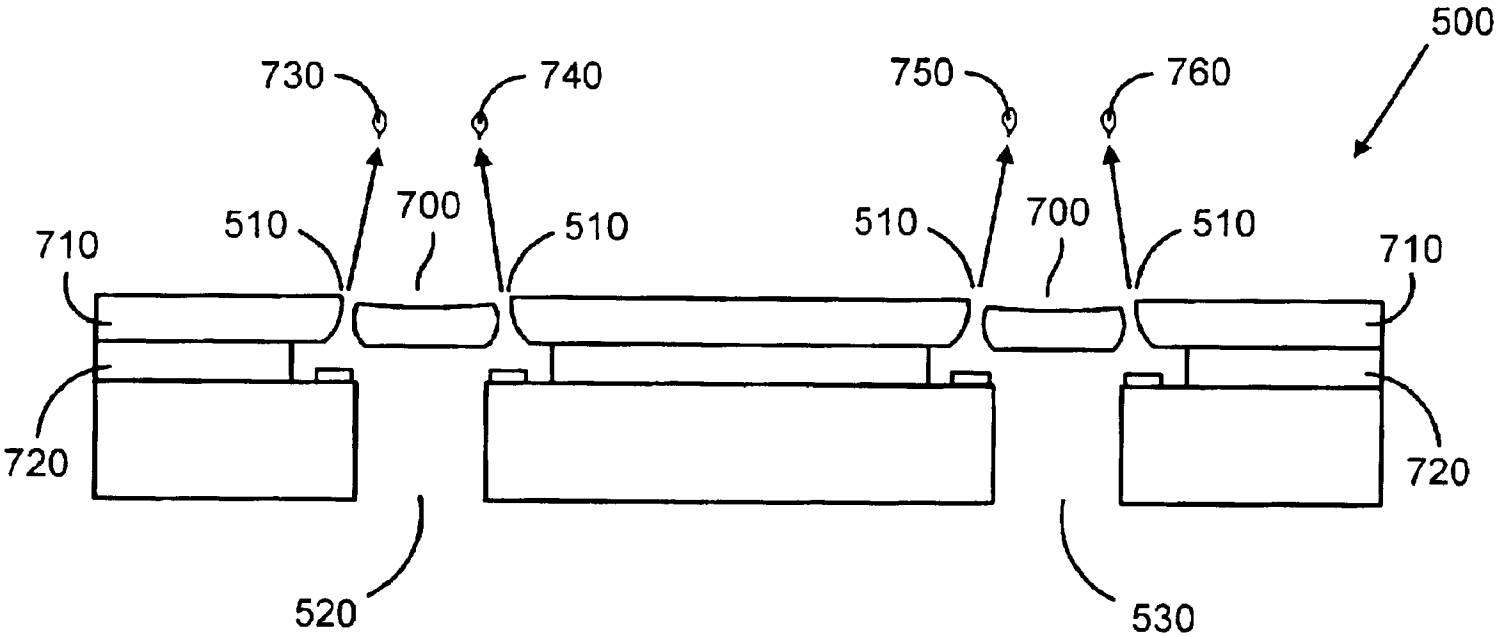
FIG. 7 is a cross-section of the printhead assembly shown in FIG. 5 illustrating the concavity caused by the manufacturing process.

One potential issue, however, with having multiple groups of nozzles is that there can be manufacturing induced geometric variations between the groups. These geometric variations can result in ink drop trajectory variation between the groups of nozzles. Specifically, FIG. 7 is a cross-section (A–A') of the printhead shown in FIG. 5 illustrating a concavity (or depression) 700 caused by the manufacturing process. This cross section is drawn through one nozzle for each of the axis groups 540, 550, 560, and 570.

One technique for manufacturing the nozzles 510 involves assembling an orifice layer 710 containing the nozzles 510 to a barrier layer 720. This process includes a step of laminating the orifice layer 710 to the barrier layer 720 using heat and pressure. The step of laminating tends to bend the orifice layer toward the ink feed slots 520, 530 and creates a concavity 700 in the orifice layer 710. This concavity 700 changes the trajectory of an ink drop ejected from an axis group of nozzles arranged along opposing edges of the ink feed slots 520, 530. Thus, instead of having a trajectory that is perpendicular to the surface of the printhead 500, the trajectory of an ink drop instead has a component in a direction parallel to the plane of the printhead 500 and toward the ink feed slots 520, 530.

For instance, referring to FIG. 7, a first ink drop 730 has been ejected from a first nozzle and a second ink drop 740 has been ejected from a second nozzle. Because of the concavity 700 in the orifice layer 710, the trajectory of the first ink drop 730 is slightly angled toward the ink feed slot 520 and the trajectory of the second ink drop 740 is slight angled toward the ink feed slot 520 with a trajectory change that is opposite the first ink drop 730. Similarly, a third ink drop 750 from a third nozzle and a fourth ink drop 760 from a fourth nozzle have similarly discrepancies. Because of spacing variations between printhead 500 and the print media, the relative positioning of ink drops on media coming from drop generators having different angular trajectories has an error component that is not predictable.

The printhead design of the present invention overcomes these trajectory effects by allowing for different print modes depending on the desired print speed, resolution and quality. In particular, the present invention allows for print modes that can operate in a one-pass 1200 dpi bidirectional mode using all four axis groups or, for higher quality print, operate in two-pass unidirectional mode using a selected pair of axis groups. For example, in a preferred embodiment, the present invention enables at least the following print modes: (1) a bidirectional one-pass 1200 dpi mode whereby all four axis groups of nozzles are operating; and (2) a unidirectional two-pass 1200 dpi mode using only axis groups 540 (group 1) and 560 (group 3) or only axis groups 550 (group 2) and 570 (group 4) to provide slower but higher quality printing. The bi-directional one-pass 1200 dpi mode (with all four axis groups operating at once) allows a full 1200 dpi swath of coverage with a single motion of printhead 500 over a print media. When printing in this mode there tends to be a trajectory error between axis group 540 (group 1) relative to axis group 550 (group 2) and between axis group 560 (group 3) relative to axis group 570 (group 4) as discussed with respect to FIG. 7. This results in some edge roughness when a vertical line is printed, among other things.

The unidirectional two-pass 1200 dpi mode requires four motions (since printing is done in only one carriage scan direction) of printhead over the print media to generate a full 1200 dpi swath. With this mode, either the first pair of axis groups (groups 540 and 560) or the second pair (groups 550 and 570) is used together for each pass of printhead 500 over the print media. As illustrated by FIG. 7, the nozzles in each pair of axis groups tend to have the same trajectory errors, or zero relative trajectory errors. This eliminates an error associated relative nozzle trajectory, reducing the roughness of vertical lines or the vertical sides of text characters. However, this mode has the disadvantage more than doubling the total time required to print relative to the bidirectional 1200 dpi mode that uses all four axis groups of nozzles at once. It should be noted that although FIG. 7 has been discussed using resolutions that are multiples of 300 dpi, it is appreciated that this methodology of increasing resolution can be applied to any base resolution.

Figure 8:
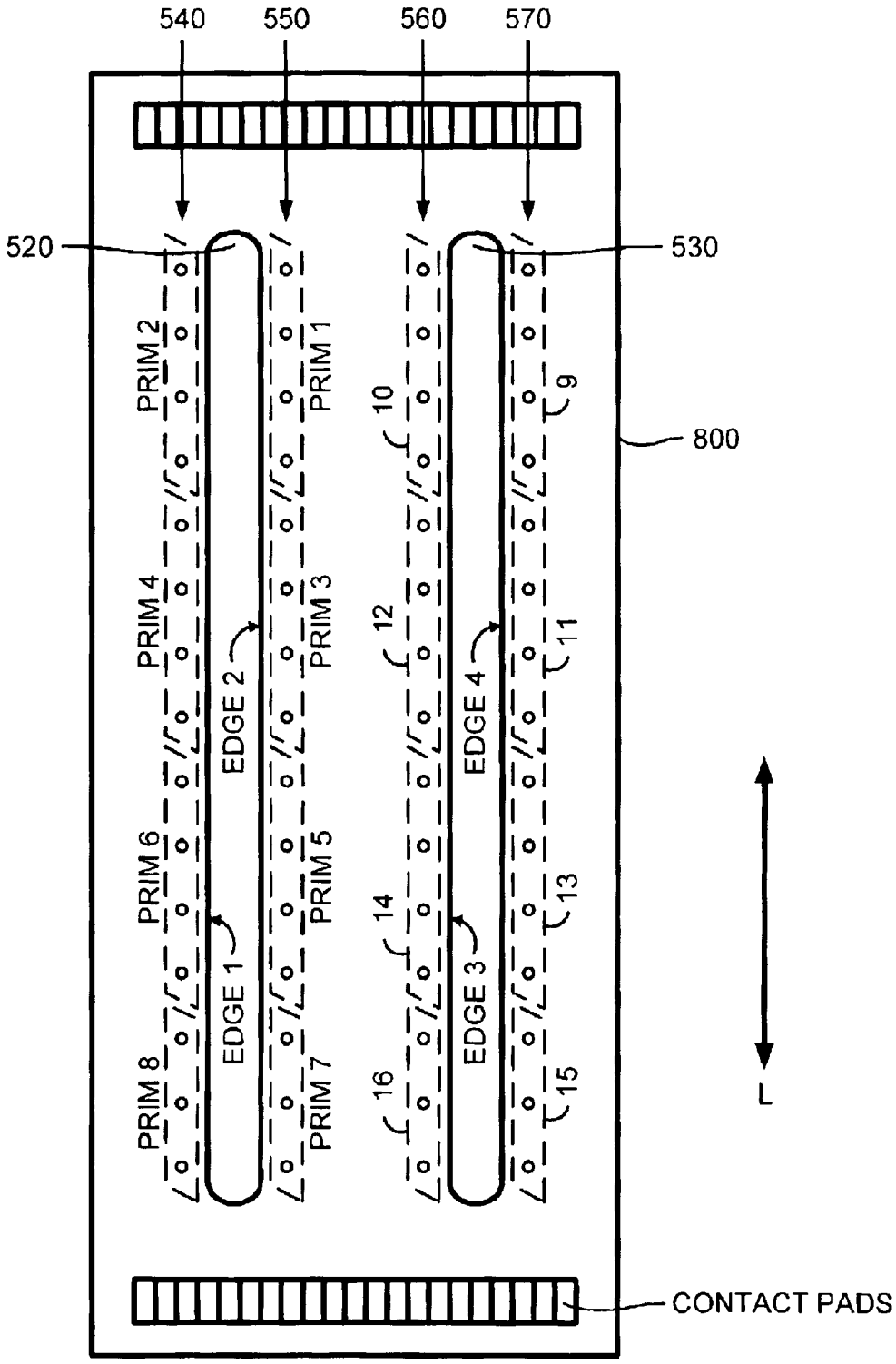
FIG. 8 is an exemplary example illustrating a greatly simplified plan view of the printhead of FIG. 5 and the arrangement of the primitives.

FIG. 8 is an exemplary example illustrating a greatly simplified plan view of the printhead of FIG. 5 and the arrangement of the primitives. The printhead 500 includes a substrate 800 upon which are located a plurality of ink drop generators disposed below nozzles 510. The substrate includes the first and second ink feed slots 520, 530 carrying ink to the axis groups of ink drop generators. The ink feed slots 520, 530 are spaced from each other in a direction transverse to the reference axis L. The ink drop generators are preferably are arranged proximate the ink feed slots 520, 530 to minimize fluid flow resistance between the ink feed slots 520, 530 and drop generators.

In a preferred embodiment, the first ink feed slot 520 has two longitudinal edges designated by edge 1 and edge 2 and the second ink feed slot has similar edge designated edge 3 and edge 4. For the first ink feed slot 520 axis groups 540 and 550 are arranged adjacent to longitudinal edges 1 and 2, respectively. For the second ink feed slot 530, axis groups 560 and 570 are arranged adjacent to longitudinal edges 3 and 4, respectively. Alternatively, other four row embodiments may be used, such as two edge feed rows and two rows arranged about a center slot.

Each of the drop generators (locations indicated by circles) includes a nozzle or orifice for ejecting ink, a heater resistor for boiling ink, and a switching circuit such as a field effect transistor coupled to the heater resistor for providing current pulses to the heater resistor. The drop generators are further arranged into groupings called primitives (indicated in FIG. 8 by primitive 1, primitive 2, etc.). One aspect of a particular primitive is that it has a primitive power lead for providing power to the particular primitive. This primitive power lead is separately energizable from each of the primitive power leads for each of the remaining primitives. Thus, a particular primitive power lead is coupled to all of the "power leads" associated with each of the switching circuits within a particular primitive. In the case where the switching circuits are field effect transistors (FETs), the particular primitive select lead is coupled to each of the source or drain connections for each FET within the particular primitive.

Another aspect of the invention is that there is a separately addressable gate lead coupled to each switching device in a particular primitive. Where the switching device is a FET, the gate lead couples to the gate connection of the FET. When a particular switching device is activated a current pulse flows from a primitive power lead, through the switching circuit, through the heater resistor, and back through a return or ground line. In order for a particular switching device to be activated, the gate lead and the primitive power line associated with that switching device must be simultaneously activated. During printhead operation, the gate leads activated one at a time in sequence. As a result, only one switching device in a particular primitive can be activated at a time. However, some or all of the primitives can be operated simultaneously.

Although FIG. 8, for the purpose of simplicity indicates only 3 or 4 drop generators per primitive, it is understood that most printhead designs will tend to have greater than 10 drop generators per primitive. Moreover, it should be noted that although FIG. 8 depicts the drop generators of each axis group as being equidistant from the longitudinal edge (substantially colinear), it is to be understood that some the drop generators may be placed at slightly varying distances from the longitudinal edge to compensate for the timing of address pulses and carriage velocity.

In an exemplary embodiment, each of the axis groups is divided into 4 primitives. In this exemplary embodiment, there are 26 gate leads. Each of the primitives each has 26 nozzles, for a total of 104 nozzles per axis group. Each primitive has at most one address connection for each of the 26 gate leads. Since the printing system cycles through gate leads during operation, only one drop generator can be operated at a time within a primitive. However, since most gate leads are shared by the primitives, multiple primitives can be fired simultaneously. In a preferred embodiment, there are at least three and preferably four primitives that overlap in the scan axis 234 (that is transverse to the media advance axis 227 and transverse to axis L) that can be operated simultaneously. This allows for much more complete and higher resolution coverage in a single scan.

Figure 9:
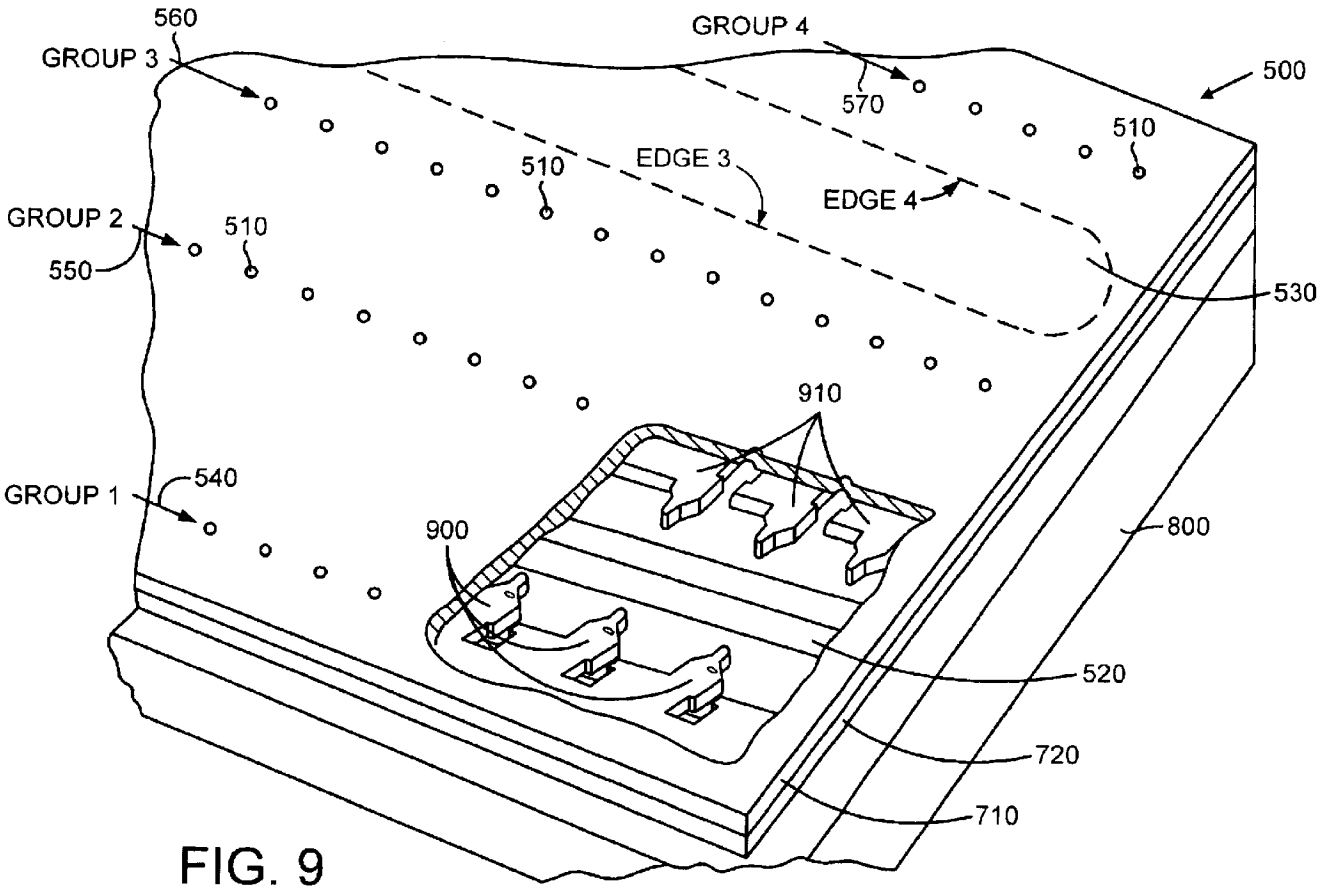
FIG. 9 is a cut-away isometric view of the printhead of FIG. 8 illustrating the various layers of the printhead.

FIG. 9 schematically illustrates a cut-away isometric view of the printhead 500 of the present invention. The printhead 500 includes a thin film substructure or die 800 comprising a substrate (such as silicon) and having various devices and thin film layers formed thereon. The printhead 500 also includes the orifice layer 710 disposed on the barrier layer 720 that in turn overlays the substrate 800. The substrate 800 includes ink drop generators that are arranged in a high-density, staggered arrangement including a first row of ink drop generators 900 and a second row of ink drop generators 910 arranged around the first ink feed slot 520. Nozzles 510 are formed into the orifice layer 710 and arranged such that each nozzle 510 has an underlying ink drop generator. Ink is feed through the first ink feed slot 520 to the ink drop generators where it is heated and ejected through the nozzles 510.

As discussed earlier with respect to FIG. 7, a lamination process is typically used to attach the orifice layer 710 to the barrier layer 720. This process tends to deform the orifice layer in a way that affects the trajectory of ink droplets to be ejected from nozzles 510. The resultant trajectory alteration tends to be approximately equal and opposite across a particular ink feed slot. Thus, axis group 540 (group 1) has the same trajectory change as axis group 560 (group 3), for example, but an opposite trajectory change relative to axis group 550 (group 2). It should be noted that although FIG. 9 depicts the barrier layer 720 and orifice layer 710 as being separate discrete layers, they can also be formed in an alternative embodiment as one integral barrier and orifice layer.

Figure 10:
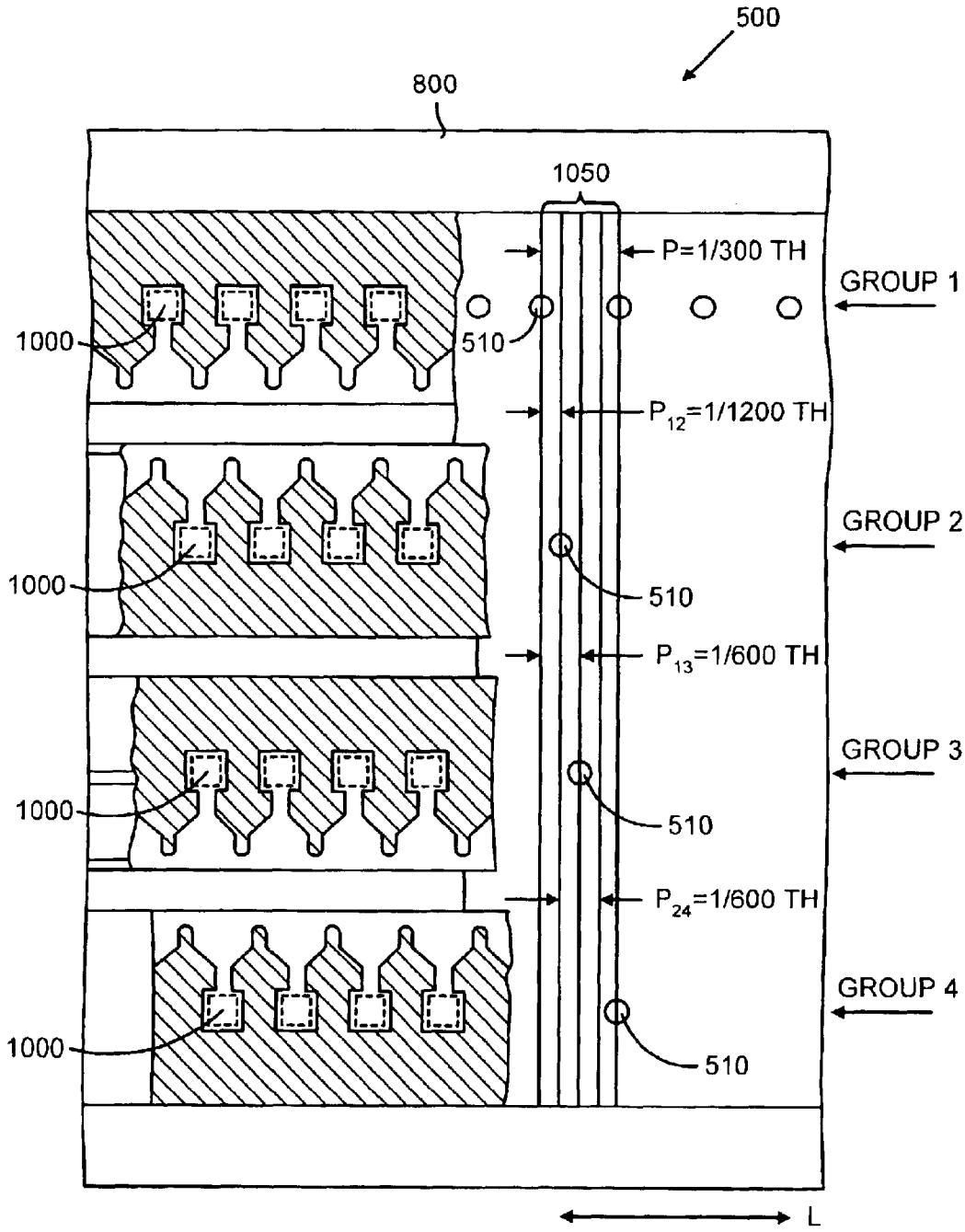
FIG. 10 depicts a top view of a portion of the printhead of the present invention with the orifice layer removed and illustrating the interleaved or staggered arrangement of ink drop generators.

FIG. 10 depicts a top view of a portion of the printhead of the present invention with the orifice layer removed and illustrating the interleaved or staggered arrangement of ink drop generators. Specifically, the printhead 500 includes ink drop generators 1000 disposed on the substrate 800. The nozzles 510 overlying the ink drop generators 1000 are arranged into axis groups, including group 1, group 2, group 3 and group 4. The axis groups of ink drop generators are spaced apart from each other transversely relative to the reference axis L. In a preferred embodiment, the reference axis L is aligned with the media advance axis 227. A single row of ink drop generators can be considered to have a certain resolution 1/P (for a single pass of printhead 500 over a print media) that is 300 dpi in an exemplary embodiment. By using this staggered arrangement of axis groups, the effective resolution is increased to 4/P when operating with all four axis groups, and 2/P when operating with a properly selected pair of the four axis groups.

The axis pitch P of a particular of a particular axis group equals the center-to-center spacing between two nearest ink drop generators projected onto or measured according to the reference axis L. In a preferred embodiment, P equals $1/300^{th}$ of an inch. Groups 1, 2, 3, and 4 are staggered relative to each other along reference axis L by P/4 or $1/1200^{th}$ of an inch for any two groups that are nearest neighbors. As illustrated, this provides a combined center-to-center spacing (again measured along the reference axis L) equal to P/4 ($1/1200^{th}$ of an inch in an exemplary embodiment). With this arrangement, the combined center-to-center spacing P13 of groups 1 and 3 equals P/2, or $1/600^{th}$ of an inch. The combined center to center spacing P24 of groups 2 and 4 also equals P/2. This high-density staggered arrangement permits the printhead of the present invention to operate in a plurality of print modes depending on the desire to optimize print speed, print quality, and resolution.

The foregoing description of the preferred embodiments of the invention has been presented for the purposes of illustration and description. It is not intended to be exhaustive or to limit the invention to the precise form disclosed. Accordingly, the foregoing description should be regarded as illustrative rather than restrictive, and it should be appreciated that variations may be made in the embodiments described by workers skilled in the art without departing from the scope of the present invention as defined by the following claims.

What is claimed is:

1. An inkjet printhead comprising:

a plurality of ink drop generators configured to receive a same color of ink and grouped into four axis groups, each of the four axis groups including a plurality of nozzles arranged along one of four axes; and wherein the drop generators are staggered with respect to one another to decrease an effective pitch of the inkjet printhead to substantially one fourth of the pitch of a single one of the four axis groups and wherein the plurality of ink drop generators provide printing resolution of at least 300 dots per inch.

2. The inkjet printhead of claim 1, wherein the plurality of ink drop generators is arranged along the four axis groups so that they are substantially parallel and spaced transverse to each other.

3. The inkjet printhead of claim 1, wherein the plurality of ink drop generators provide printing resolution of at least 600 dots per inch.

4. The inkjet printhead of claim 1, wherein the plurality of ink drop generators are fluidically coupled to an ink reservoir containing a single color of ink.

5. The inkjet printhead of claim 1, wherein a portion of the plurality of ink drop generators are arranged to approximately double a print resolution with respect to a plurality of ink drop generators arranged along a single axis.

6. The inkjet printhead of claim 1, further comprising a first ink feed slot disposed between a first axis group and a second axis group and a second ink feed slot disposed between a third axis group and a fourth axis group.

7. The inkjet printhead of claim 1, wherein each axis group has an axis pitch of approximately $1/300^{th}$ of an inch and wherein a combination of the four axis groups has an effective pitch of approximately $1/1200^{th}$ of an inch.

8. A fluid ejection device, comprising:

a plurality of drop generators arranged into four axis groups that are each arranged along one of four separate axes, each of the four separate axes are substantially parallel to a reference axis L and spaced apart transversely from the remaining ones of the four separate axes;

wherein each axis group having drop generators with an axis pitch P with respect to the reference axis L and the plurality of drop generators having a staggered arrangement such that the combined center to center spacing of the plurality of drop generators with respect to the axis L is P/4 and wherein the axis pitch P is $1/300^{th}$ of an inch to allow a combined center to center spacing of the plurality of drop generators to be $1/1200^{th}$ of an inch.

9. The fluid ejection device of claim 8, wherein the plurality of drop generators are configured to eject the same colorant of ink.

10. The fluid ejection device of claim 8, wherein the fluid ejection device is a disposable print cartridge.

11. The fluid ejection device of claim 8, further comprising a carriage assembly for imparting relative motion between the fluid ejection device and a print media, an ink supply device fluidically coupled to the plurality of drop generators and a controller for controlling operation of the carriage assembly.

12. The fluid ejection device of claim 11, wherein the ink supply device is an ink reservoir containing a single color of ink.

13. The fluid ejection device of claim 8, wherein at least one of the four axis groups is substantially parallel to a media advance axis.

14. An inkjet printhead comprising:

a substrate having two ink feed slots including a first ink feed slot having two longitudinal edges including edge 1 and edge two and a second ink feed slot having two longitudinal edges including edge 1 and edge two; and a plurality of ink drop generators arranged along the longitudinal edges including an axis group 1 arranged along edge 1, an axis group 2 arranged along group 2, and axis group 3 arranged along edge 3, and an axis group 4 arranged along edge 4;

wherein each axis group having a drop generator pitch P with respect to a reference axis L and wherein axis group 1 is staggered with respect to axis group 3 to provide an effective drop generator pitch of P/2 with respect to the reference axis L and wherein the reference group 2 is staggered with respect to the reference group 4 to provide an effective drop generator pitch of P/2 with respect to reference axis L and wherein the plurality of ink drop generators provide printing resolution of at least 300 dots per inch.

15. The inkjet printhead of claim 14, wherein the effective pitch drop generator pitch of the plurality of drop generators is P/4.

16. The inkjet printhead of claim 14, wherein the plurality of drop generators are configured to eject the same color of ink.

17. The inkjet printhead of claim 14, wherein the plurality of drop generators provide printing resolution of at least 600 dots per inch.

18. A method for fabricating an inkjet printhead, comprising:

providing a plurality of ink drop generators with a same colorant of ink, wherein the plurality of ink drop generators are grouped into four axis groups, each of the four axis groups including a plurality of nozzles arranged along one of four axes and wherein the drop generators are staggered with respect to one another; and decreasing an effective pitch of the inkjet printhead to substantially one fourth of the pitch of a single one of the four axis groups;

wherein the plurality of ink drop generators provide printing resolution of at least 300 dots per inch.

19. The method of claim 18, wherein the plurality of ink drop generators is arranged along the four axis groups so that they are substantially parallel and spaced transverse to each other.

20. The method of claim 18, further comprising using the plurality of ink drop generators to create a resolution of at least 600 dots per inch.

21. The method of claim 18, further comprising fluidically coupling the plurality of ink drop generators to an ink reservoir containing a single color of ink.

22. The method of claim 18, further comprising doubling a print resolution with respect to a plurality of ink drop generators arranged along a single axis.

23. The method of claim 18, further comprising providing a first ink feed slot disposed between a first axis group and a second axis group and a second ink feed slot disposed between a third axis group and a fourth axis group.

24. An inkjet printhead assembly comprising:

means for providing a plurality of ink drop generators with a same color of ink, wherein the ink drop generators are grouped into four axis groups, each of the four axis groups including a plurality of nozzles arranged along one of four axes; and means for decreasing an effective pitch of the inkjet printhead to substantially one fourth of the pitch of a single one of the four axis groups using a staggered arrangement of the ink drop generators with respect to one another and wherein the plurality of ink drop generators provide printing resolution of at least 300 dots per inch.

25. The inkjet printhead assembly of claim 24, wherein the plurality of ink drop generators are fluidically coupled to an ink reservoir containing a single color of ink.

26. The inkjet printhead assembly of claim 24, further comprising a substrate having two ink feed slots including a first ink feed slot having at least two longitudinal edges and a second ink feed slot having at least two longitudinal edges.

27. The inkjet printhead assembly of claim 26, wherein two of the four axes groups of the plurality of ink drop generators are arranged along two of the longitudinal edges of the first ink feed slot and two of the four axes groups of the plurality of ink drop generators are arranged along two of the longitudinal edges of the second ink feed slot.

* * * * *

UNITED STATES PATENT AND TRADEMARK OFFICE

CERTIFICATE OF CORRECTION

PATENT NO. : 7,048,355 B2
APPLICATION NO. : 10/434880
DATED : May 23, 2006
INVENTOR(S) : Joseph M. Torgerson et al.

It is certified that error appears in the above-identified patent and that said Letters Patent is hereby corrected as shown below:

On the title page, item (57), under "Abstract", in column 2, line 3, delete "recieve" and insert -- receive --, therefor.

In column 14, line 1, in Claim 24, delete "assembly" and insert -- assembly, --, therefor.

Signed and Sealed this

Twenty-first Day of April, 2009

JOHN DOLL
*Acting Director of the United States Patent and Trademark Office*